US011572138B2

(12) United States Patent
Pieschel

(10) Patent No.: US 11,572,138 B2
(45) Date of Patent: Feb. 7, 2023

(54) INFLATABLE STAND UP PADDLEBOARD WITH THERMALLY INSULATED COMPARTMENT

(71) Applicant: Nicholas Pieschel, East Sandwich, MA (US)

(72) Inventor: Nicholas Pieschel, East Sandwich, MA (US)

( * ) Notice: Subject to any disclaimer, the term of this patent is extended or adjusted under 35 U.S.C. 154(b) by 51 days.

(21) Appl. No.: 17/192,476

(22) Filed: Mar. 4, 2021

(65) Prior Publication Data

US 2022/0281564 A1 Sep. 8, 2022

(51) Int. Cl.

| | |
|---|---|
| ***B63B 32/51*** | (2020.01) |
| ***B63B 7/08*** | (2020.01) |
| ***B63B 34/52*** | (2020.01) |
| ***B63B 32/70*** | (2020.01) |

(52) U.S. Cl.

CPC ..... *B63B 32/51* (2020.02); *B63B 7/082* (2013.01); *B63B 7/085* (2013.01); *B63B 32/70* (2020.02); *B63B 34/52* (2020.02)

(58) Field of Classification Search

CPC ..... B63B 32/51; B63B 32/70; B63B 32/77; B63B 34/52; B63B 7/08; B63B 7/082; B63B 7/085; B63C 11/49

See application file for complete search history.

(56) References Cited

U.S. PATENT DOCUMENTS

| | | | | |
|---|---|---|---|---|
| 4,691,658 | A | 9/1987 | New | |
| 4,693,691 | A * | 9/1987 | DeYoe | B63C 9/30 5/656 |
| 4,955,835 | A | 9/1990 | Hollingsworth | |
| 5,127,860 | A | 7/1992 | Kraft | |
| 5,857,682 | A | 1/1999 | Hyman | |
| 6,241,569 | B1 * | 6/2001 | Harkrider | B63C 11/49 114/66 |
| 6,386,382 | B1 | 5/2002 | McCausland | |
| 6,863,014 | B2 | 3/2005 | Hudson | |
| 6,925,834 | B2 | 8/2005 | Fuchs | |
| 7,165,505 | B2 | 1/2007 | Franchetti | |
| 8,671,502 | B2 | 3/2014 | Nazzari | |
| 8,672,719 | B2 * | 3/2014 | Grimes | B63B 32/50 441/74 |
| 9,908,595 | B1 | 3/2018 | Kokinelis | |
| 10,486,781 | B2 * | 11/2019 | Cavazos | B63B 32/77 |
| 10,791,844 | B2 | 10/2020 | Le Gette | |
| 10,913,518 | B2 * | 2/2021 | Prade | B63B 73/46 |
| 2003/0153221 | A1 * | 8/2003 | Weir | B63B 32/51 441/66 |
| 2006/0270289 | A1 | 11/2006 | Blakely | |

(Continued)

FOREIGN PATENT DOCUMENTS

| | | |
|---|---|---|
| CN | 201617335 | 11/2010 |
| DE | 202019104505 U1 * | 10/2019 |
| WO | 2006042359 | 4/2006 |

*Primary Examiner* — Ajay Vasudeva

(74) *Attorney, Agent, or Firm* — Lambert Shortell & Connaughton; David J. Connaughton, Jr.; Justin P. Tinger

(57) ABSTRACT

An inflatable stand up paddleboard, combined with a thermally insulated compartment is disclosed herein. The compartment may be used for storage of food, drink, personal effects, and other items that may require storage in a temperature stabilized medium. As constructed, the compartment and storage of items therein does not diminish the functionality or versatility of the inflatable paddleboard.

4 Claims, 8 Drawing Sheets

(56) References Cited

U.S. PATENT DOCUMENTS

| | | | |
|---|---|---|---|
| 2007/0012236 | A1 | 1/2007 | Caples |
| 2013/0335205 | A1 | 12/2013 | Willner |
| 2014/0213127 | A1 | 7/2014 | Bonner |
| 2015/0059637 | A1 | 3/2015 | Johns |
| 2015/0191228 | A1 | 7/2015 | Ventura |
| 2019/0178565 | A1 | 6/2019 | Horton |

* cited by examiner

INFLATABLE STAND UP PADDLEBOARD WITH THERMALLY INSULATED COMPARTMENT

BACKGROUND

Technical Field

The present disclosure relates generally to paddleboards and water sports involving paddleboards. More particularly the present disclosure relates to an inflatable stand up paddleboard, combined with a thermally insulated compartment for storage of food, drink, personal effects, and other items that may require storage in a temperature stabilized medium, that does not diminish the functionality or versatility of the inflatable board.

Description of Related Art

Stand up paddle boarding has existed as a water sport in one form or another for over a hundred years. Modern stand up paddle boarding in its current form and popularization began in the 1940s as an alternative to surfing. Over the years, different variations of stand up paddle boarding came into existence, such as stand up paddleboard touring, stand up paddleboard yoga, and stand up paddleboard fishing, to name a few.

Paddleboards come in many shapes and sizes and are comprised of different materials depending on the type of paddleboard and the height, weight, and skill of the user. Solid paddleboards typically have a foam core that is covered by one of many different materials, including, wood veneers, fiberglass, or carbon fiber. Epoxy resin can be added on top of those materials to create a stronger board.

Inflatable paddleboards are a popular option for paddleboarders looking for a more portable board that has the same functionality as solid boards. Inflatable stand up paddleboards are stable due to their core comprised of thousands of fine threads made from nylon or other analogous material that is covered by at least one layer of vinyl material, typically PVC. Inflatable paddleboards that can be deflated and rolled up small enough to fit into a bag or backpack for easy travel are known in the art. However, despite their versatility, inflatable stand up paddleboards lack storage options for their users.

Therefore, what is needed is an inflatable stand up paddleboard with a thermally insulated compartment having the following characteristics and benefits over the prior art.

SUMMARY

The subject matter of this application may involve, in some cases, interrelated products, alternative solutions to a particular problem, and/or a plurality of different uses of a single system or article.

It is an object of the present invention to provide a convenient insulated storage option integrated into an inflatable stand up paddleboard. It is another object to provide this storage option without sacrificing the performance of the fully inflated paddleboard or the portability of the fully deflated paddleboard.

In one aspect of the present invention, an already existing and familiar structure, the fully inflated inflatable stand up paddleboard is utilized, and a thermally insulated storage compartment is combined with the structure. The combination is unique and there is no previous evidence of its design in the prior art. In some embodiments, the inflatable stand up paddleboard defines a void for holding the compartment, which, until it is secured to the paddleboard, is separate from the board. For example, the void may be within the front or back of the paddleboard, and the compartment can be secured optionally in either variation without sacrificing the integrity and functionality of the inflatable paddleboard. The compartment may be secured to the paddleboard using a urethane adhesive glue; however, it should be noted that the compartment may be secured to the paddleboard in any way that does not diminish the integrity or functionality of the paddleboard.

In another aspect of the present invention, the inflatable stand up paddleboard may be comprised of a core of a plurality of threads that may be made from nylon or other analogous material and covered by at least one layer of a vinyl, including, but not limited to PVC or PEVA. The plurality of threads join top and bottom of the board. When the board is fully inflated the threads confine the movement of the top and bottom of the paddleboard so that the board maintains its shape. The void generally does not contain any material. The inflatable stand up paddleboard may also have a valve for inflation and deflation. The standing side of the paddleboard may have a meshed foam or rubber material connected to the vinyl layer to allow the user better stability when standing and controlling the board. The bottom side of the paddleboard may have several fins to allow the user better control when steering the direction of the board. The paddleboard may also have a leash plug for attaching a leash to the board. The paddleboard may also have a handle attached to the standing side of the paddleboard to give the user ease of carrying the fully inflated board.

In yet another aspect of the present invention, the compartment may be comprised of a vinyl material, including, but not limited to, PVC or PEVA. The compartment may have an inside layer and an outside layer both comprised of the vinyl material. The compartment may contain thermally insulating material between both the inside layer and outside layer. The thermal insulation material may be a foam and/or aluminized sheet, comprised of any one of polystyrene, polyethylene, polyurethane, or reflective insulation; however, it should be noted that the insulating material may be any material capable of providing a temperature-controlled environment.

In another aspect of the present invention, the compartment may have a waterproof zipper on the outside layer for opening and closing the compartment.

In yet another aspect of the present invention, additional sheets of vinyl material, such as PVC or PEVA, may be secured to the inflatable paddleboard as a cover for the compartment within the void and a cover for the bottom of the void, respectively. These additional vinyl sheets may provide stability to both the top and bottom of the inflatable paddleboard.

In another aspect of the present invention, the vinyl sheets may be used to secure insulation between a sheet and the compartment, the sheet and space within the void not filled by the compartment, or both. In some embodiments the insulation used may be a foam comprised of any one of polystyrene, polyethylene, or polyurethane. In other embodiments the insulation used may be reflective insulation. The reflective insulation may be placed on the outside of the sheet or over the compartment without the sheet, depending on the embodiment.

It should be understood that the inflatable paddleboard, the void, the compartment, the vinyl sheets, and the varying types and amounts of insulation utilized in different embodiments may be of varying sizes and shapes without straying from the scope of the present invention.

DETAILED DESCRIPTION

Figure 1:
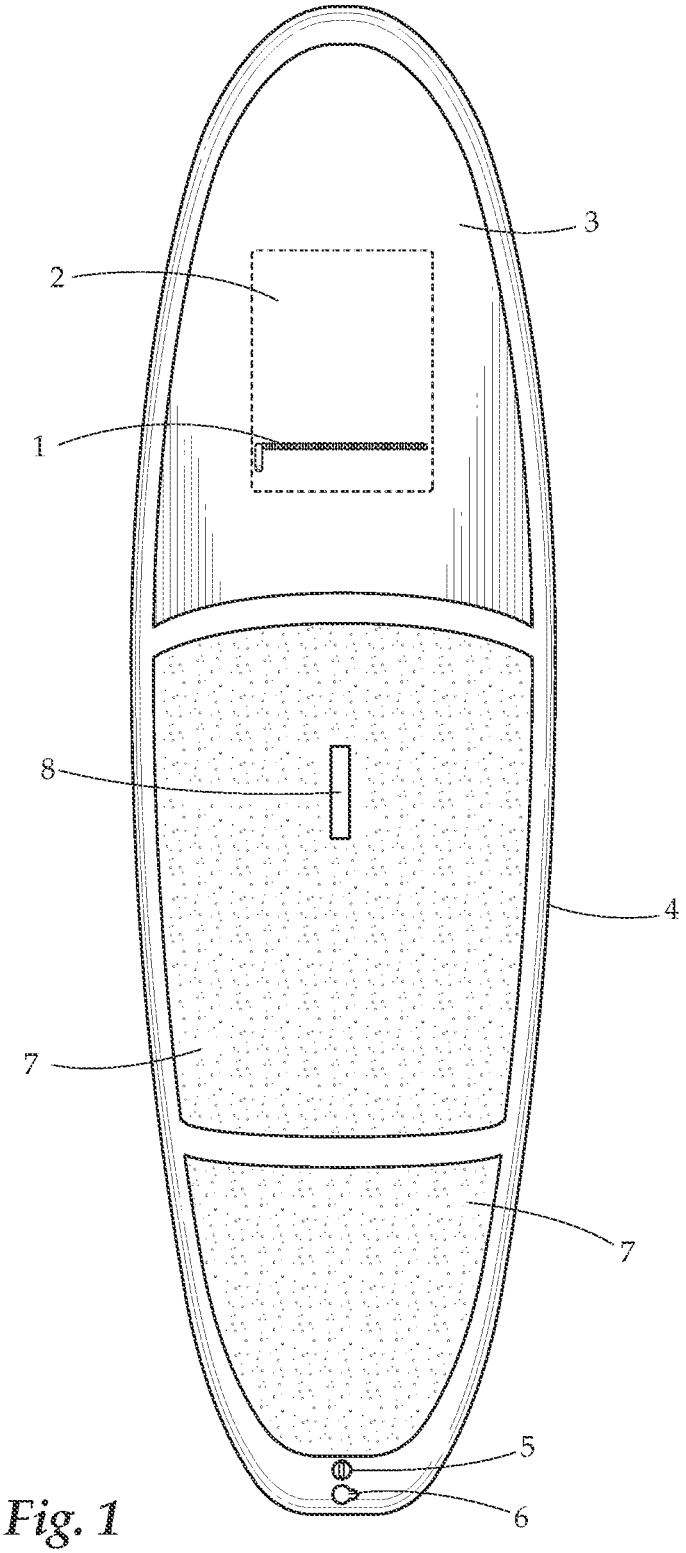
FIG. 1 provides a perspective view of an embodiment of the present invention.

The detailed description set forth below in connection with the appended drawings is intended as a description of presently preferred embodiments of the invention and does not represent the only forms in which the present disclosure may be constructed and/or utilized. The description sets forth the functions and the sequence of steps for constructing and operating the invention in connection with the illustrated embodiments.

Generally, the present disclosure concerns an inflatable stand up paddieboard with a thermally insulated compartment or storage receptacle configured to preserve both the versatility of a paddleboard that may be inflated or deflated and the convenience of portable storage. The embodiments described herein can allow the user to store food, drink, or other items in a temperature controlled environment within the paddleboard while not sacrificing the stability of the board in use, which provides for a better inflatable stand up paddleboard experience overall.

Inflatable stand up paddleboards are in some cases made of "drop stitch fabric" construction which are made from a core of a plurality of threads that may be made from nylon or other analogous material and that is covered by at least one layer of a vinyl material. The plurality of threads join top and bottom of the board. When the board is fully inflated the threads confine the movement of the top and bottom of the paddleboard so that the board maintains its shape. Inflatable stand up paddleboards may vary in size, shape, and color for various performance and aesthetic reasons.

The combination between the inflatable stand up paddleboard and the insulated compartment or storage recetacle is accomplished generally by creating the void within either the front or back of an inflatable stand up paddleboard. The void is non-pressurized and is completely separated from the pressurized air within the body of the inflatable board by interior walls, so that the storage receptacle extends and is secured to the paddleboard. In some embodiments, the compartment is made from a vinyl material and may be opened and closed by a waterproof zipper; however, it should be understood that any material that may be secured to an inflatable paddleboard and any structure for opening and closing the compartment that yields a waterproof compartment may be utilized.

In some embodiments, the compartment has an outside layer and an inside layer, where the outside layer has a larger surface area than the surface area of the inside layer and is connected to an essentially flat surface made from the same material as both inside and outside layers. Both the outside layer connected to the flat surface and the inside layer are referred to collectively as the "compartment." Thermal insulation may be secured between the portion of the outside layer that is not the essentially flat surface and the inside layer. In the preferred embodiments, the thermal insulation is a foam layer comprised of at least one of polystyrene, polyethylene, or polyurethane; however, the insulation may be comprised of any material capable of yielding a temperature-controlled compartment. The thickness and shape of the insulation layer depends on the space between the inside layer and outside layer of the compartment and the shape of the compartment, respectively. The insulation between the two layers of the compartment reduces the rate of heat transfer between food, drink, and other items stored within the compartment and the outside environment.

In other embodiments, vinyl sheets, that may be comprised of PVC or PEVA, are secured to the inflatable paddleboard on both the bottom side and the standing side in a way that covers the void created for receiving the compartment. Additional insulation may be placed between the top sheet and the bottom sheet, simultaneously or alternatively, depending on the embodiment. In the preferred embodiments, the additional insulation is a foam insulation layer comprised of at least one of polystyrene, polyethylene, or polyurethane; however, the insulation may be any material capable of decreasing the rate of heat transfer between the compartment and the outside environment. For example, in some embodiments, reflective insulation may be utilized.

Turning now to FIG. 1, which shows the body of an inflatable paddleboard 4 in its inflated state. The body 4 is comprised of a leash plug 5 for attaching an optional leash that may be attached to the user, typically some part of the user's leg; a valve 6 for inflating and deflating the body; meshed foam or rubber material 7 for providing more grip and stability for a standing user; and a handle 8. FIG. 1 also shows the compartment 2 with a waterproof zipper 1 for opening and closing the compartment. A top vinyl sheet layer 3 may be connected to the body 4 covering the compartment 2 without covering the zipper 1 in order to provide additional stability and aesthetics.

Figure 2:
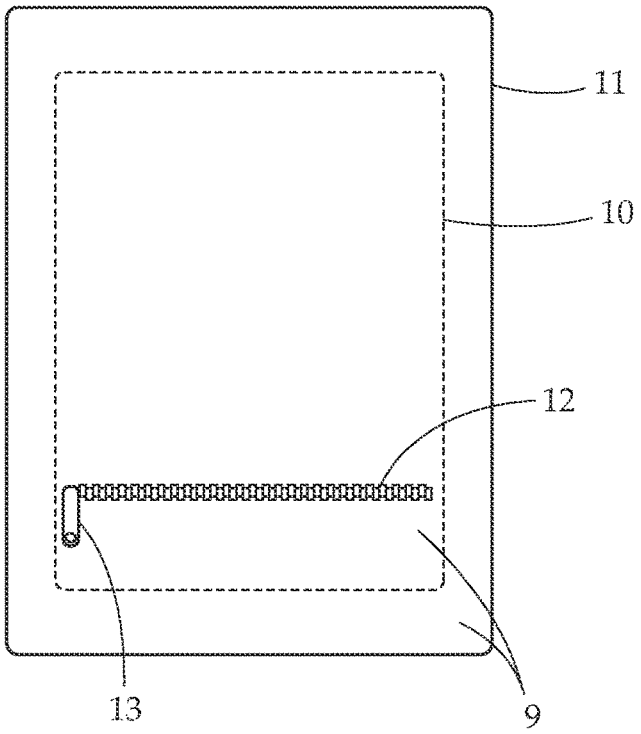
FIG. 2 provides a zoomed in perspective view of another embodiment of the present invention.

FIG. 2 shows an embodiment of the compartment comprised of an outside layer 9, an inside layer 10, and an essentially flat surface portion 11 of the outside layer 9, where the teeth of the waterproof zipper 12 are secured to the outside layer 9, and the handle of the zipper 13 is used to open and close the teeth 12. Insulation may be secured between the outside layer 9 and the inside layer 10 of the compartment. The essentially flat surface portion 11 of the outside layer 9 is what secures the compartment to the body.

Figure 3:
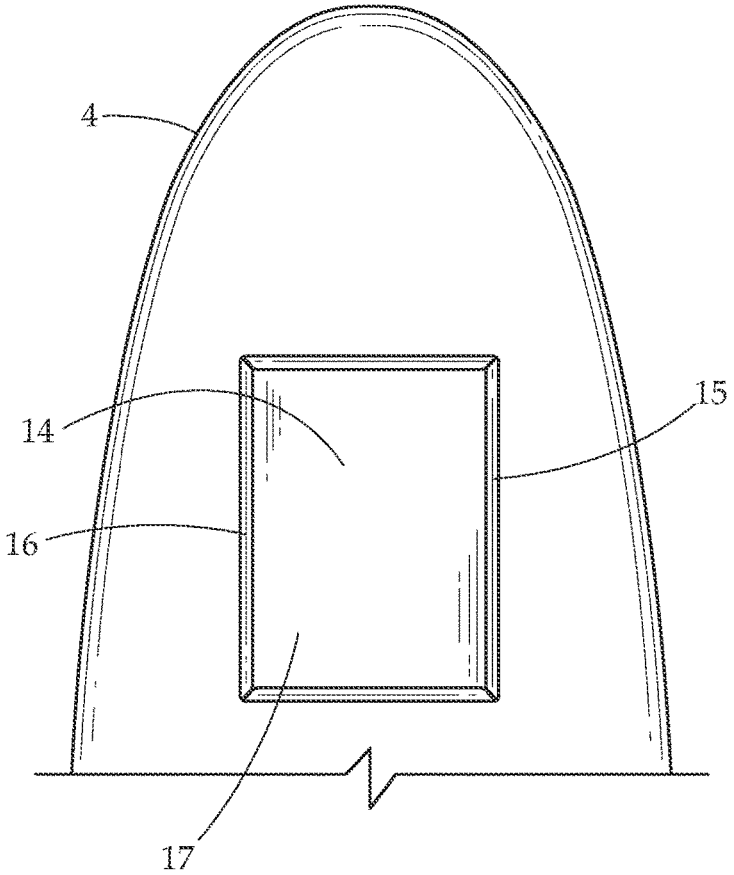
FIG. 3 provides a top-down zoomed in perspective view of another embodiment of the present invention.

FIG. 3 shows an embodiment of the void 14 that is created in the body 4 with the left interior wall 16 and the right interior wall 15 of the body 4, which are two examples of the interior walls separating the pressurized air that inflates the body 4 from the non-pressurized void 14. An additional vinyl sheet layer 17 may be secured to the bottom of the body 4 to cover the opening created by the void 14. When the additional bottom vinyl sheet layer 17 is secured to the bottom of the body 4, the vinyl sheet layer 17 is considered a part of the body 4.

Figure 4:
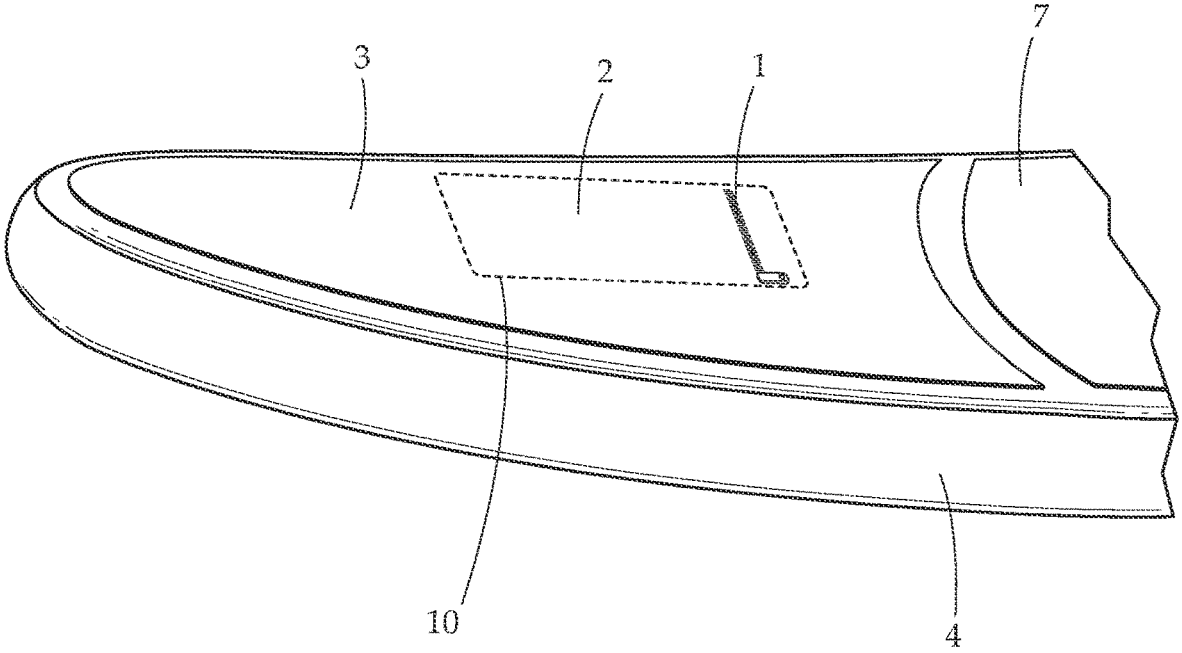
FIG. 4 provides a side zoomed in perspective view of another embodiment of the present invention.

FIGS. 1 and 4 show two different views of another embodiment of the body 4 and the compartment 2.

Figure 5:
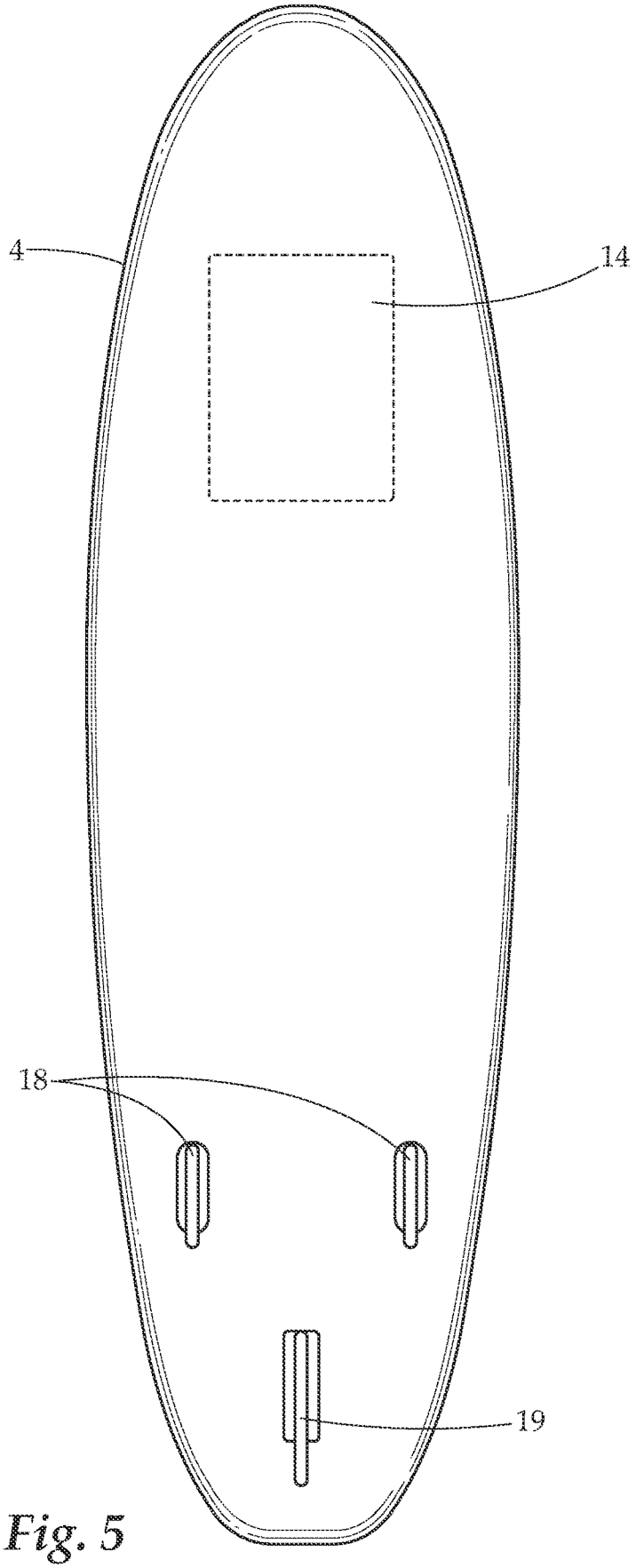
FIG. 5 provides a perspective view of the bottom side of another embodiment of the present invention.

FIG. 5 shows yet another embodiment of the body 4 and the void 14, where the body 4 has left and right fins 18 and a center fin 19 connected to it allowing the paddleboard user to better control the direction of the board.

Figure 6:
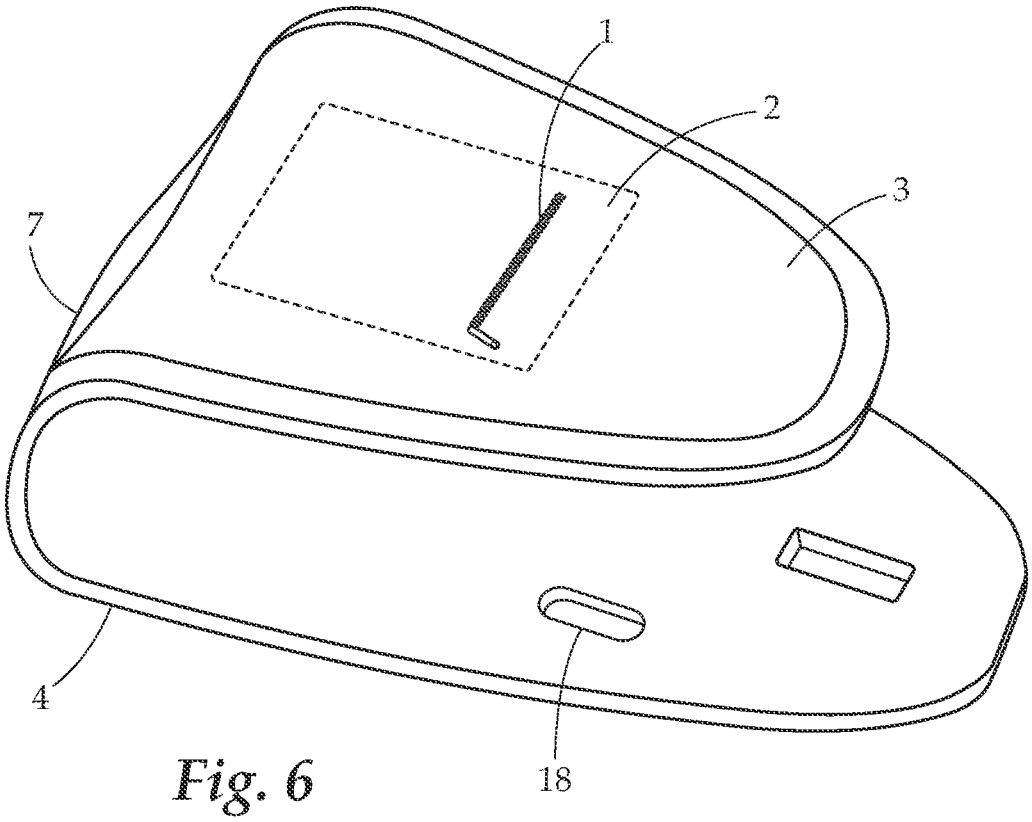
FIG. 6 provides a perspective view of a partially folded embodiment of the present invention.

FIG. 6 shows a partially deflated embodiment of the body 4 and the compartment 2, where one of the left and right fins 18 is being folded along with the body 4.

Figure 7:
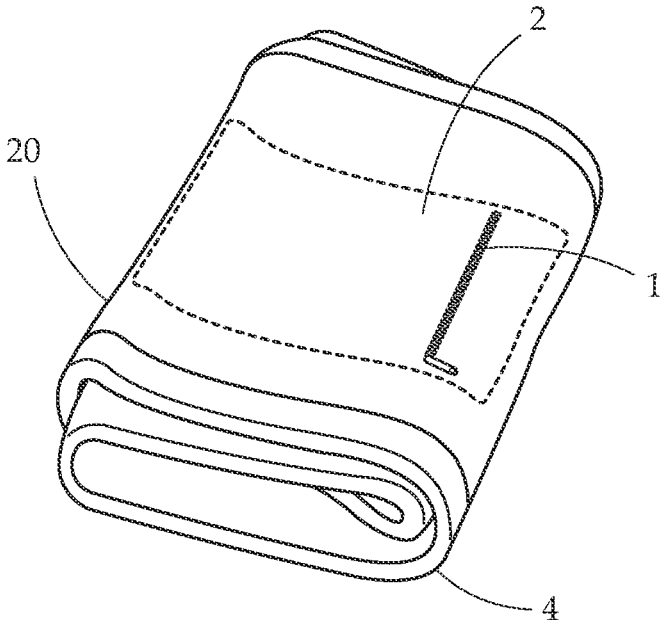
FIG. 7 provides a perspective view of a completely folded embodiment of the present invention.

FIG. 7 shows a completely deflated embodiment of the body 4 and the compartment 2. When completely deflated, the inflatable paddleboard can be compressed into a roll 20 small enough to fit in a travel backpack, for example.

Figure 8:
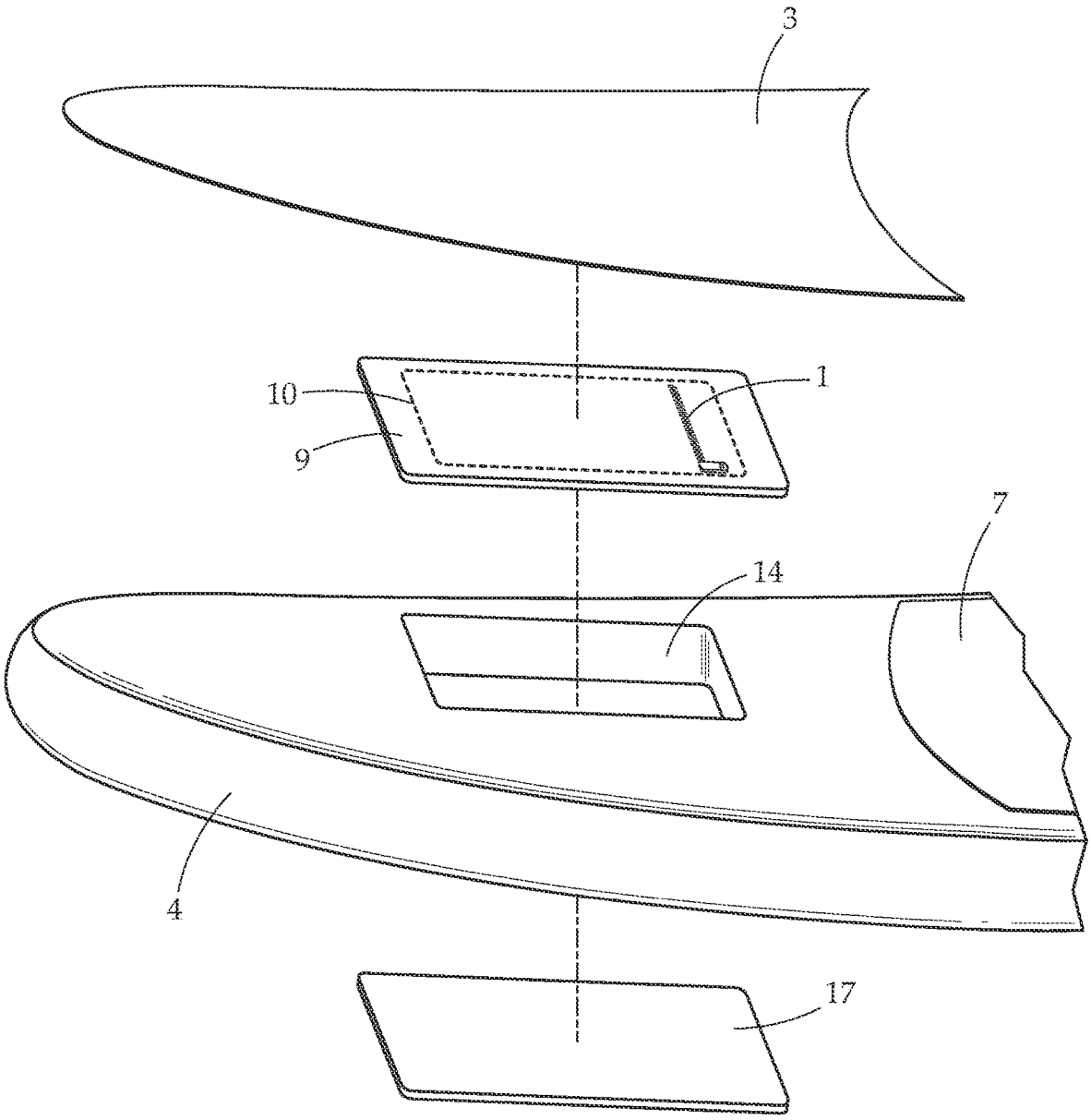
FIG. 8 provides a partiallyexploded perperspective view of another embodiment of the present invention.

FIG. 8 shows a partially exploded embodiment of the body 4, the non-pressurized void 14, the outside layer 9 and inside layer 10 of the compartment, the top vinyl sheet layer 3, and the bottom vinyl sheet layer 17. Once, either top vinyl sheet layer 3, bottom vinyl sheet layer 17, or both are secured to the body 4, they are included within the meaning of "body". In some embodiments an insulation layer may be secured between the top vinyl sheet 3 and the outside layer 9 of the compartment, while still providing an opening in the insulation layer and the top sheet 3 for the user to easily access the zipper 1. In other embodiments, an insulation layer may be placed in the void 14 between the bottom vinyl sheet 17 and the outside layer 9 of the compartment. In yet more embodiments, insulation layers may be secured between top sheet 3 and outside layer 9 and bottom sheet 17 and outside layer 9, simultaneously.

Figure 9:
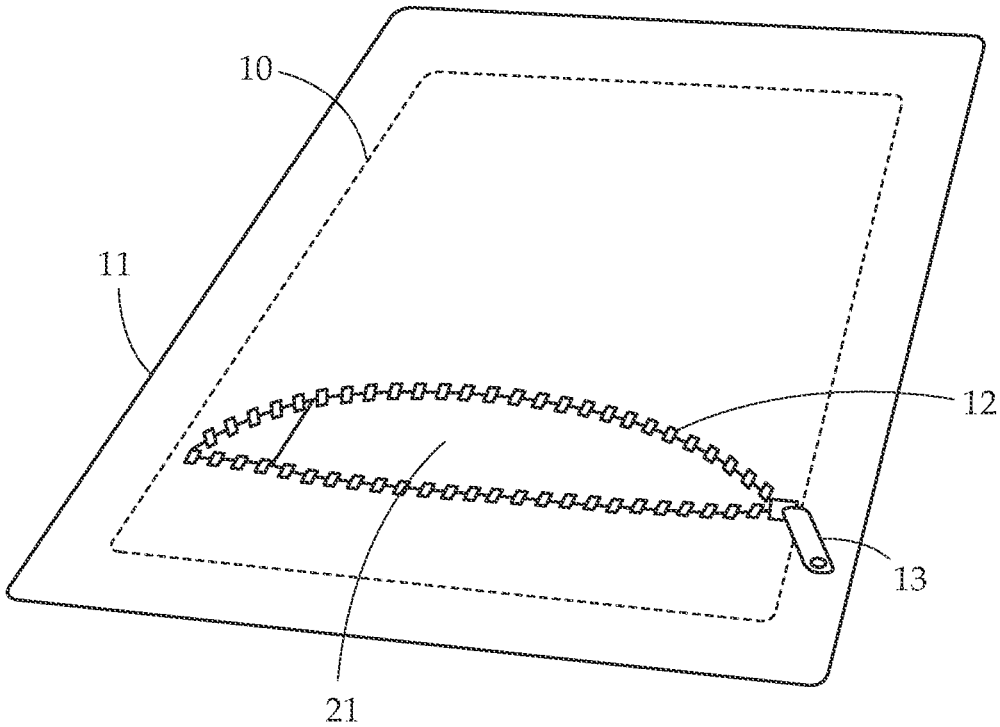
FIG. 9 provides a perspective view of an interior embodiment of the present invention.
Figure 10:
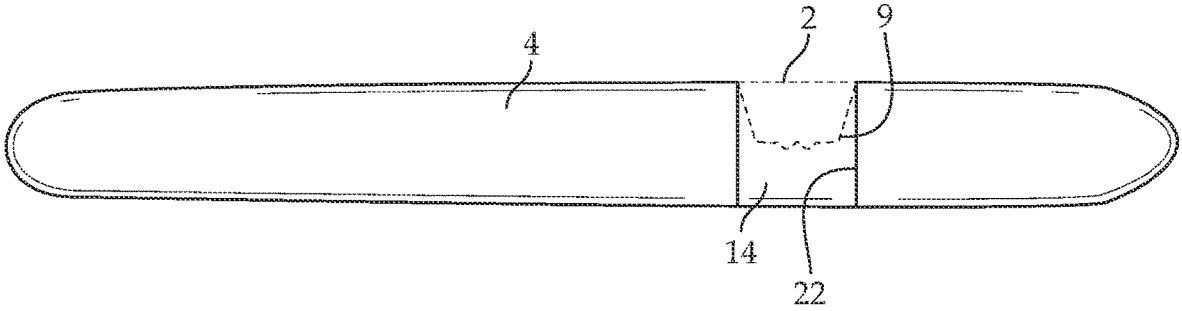
FIG. 10 provides a cross sectional perspective view an embodiment of the present invention.

Finally, FIG. 9 shows a zoomed in view of one embodiment of the inside layer 10 of the compartment, where the teeth 12 of the zipper are opened to reveal the inside 21 of the compartment. More layers of insulation should provide an increasingly better temperature stabilized environment inside 21. FIG. 10 provides a cross sectional perspective view of an embodiment of the body 4 of the paddleboard. In this illustrated embodiment, the body 4 defines a non-pressurized void 14, wherein the compartment or storage receptacle 2, extends into the void 14, as shown. In this illustrated embodiment, it is also shown that the storage receptacle 2 comprises a volume less than the volume of the void 14.

While several variations of the present disclosure have been illustrated by way of example in preferred or particular embodiments, it is apparent that further embodiments could be developed within the spirit and scope of the present disclosure, or the inventive concept thereof. However, it is to be expressly understood that such modifications and adaptations are within the spirit and scope of the present disclosure, and are inclusive, but not limited to the following appended claims as set forth below.

What is claimed is:

1. An inflatable stand up paddleboard comprising:

an inflatable body, the inflatable body defining a paddleboard shape with a front, a back, a top, surface, and a bottom surface;

wherein interior walls of the inflatable body define a non-pressurized void within the body;

a thermally insulated storage receptacle comprising an outside layer and an inside layer, a flat surface on a periphery of the outside layer secured over the top surface of the inflatable body, wherein the storage receptacle is configured to extend into the void;

wherein the storage receptacle comprises a material encompassing a volume less than the volume of the void; and a waterproof zipper secured to the outside layer at a top end of the storage receptacle to provide access inside the storage receptacle.

2. The inflatable stand up paddleboard of claim 1 wherein the body is covered by at least one layer of a vinyl material and a valve that reciprocally opens and closes for inflating and deflating the body.

3. The inflatable stand up paddleboard of claim 1 wherein the body defines the void within the front of the body.

4. The inflatable stand up paddleboard of claim 1 wherein the void is defined through a height of the body by at least one sidewall extending from the top of the body to the bottom of the body.

* * * * *